US008172343B2

(12) United States Patent
Muth

(10) Patent No.: US 8,172,343 B2
(45) Date of Patent: May 8, 2012

(54) CARRIAGELESS MOBILIZED STORAGE UNIT FOR USE IN A MOBILE STORAGE SYSTEM

(75) Inventor: James C. Muth, Oconomowoc, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 376 days.

(21) Appl. No.: 12/396,829

(22) Filed: Mar. 3, 2009

(65) Prior Publication Data

US 2010/0226743 A1 Sep. 9, 2010

(51) Int. Cl.

| | |
|---|---|
| ***A47B 53/00*** | (2006.01) |
| ***A47B 77/00*** | (2006.01) |
| ***A47B 87/00*** | (2006.01) |
| ***A47B 95/00*** | (2006.01) |

(52) U.S. Cl. ..... 312/201

(58) Field of Classification Search ..... 312/201, 312/200, 199, 249.8, 265.1–265.4, 257.1, 312/263, 351

See application file for complete search history.

(56) References Cited

U.S. PATENT DOCUMENTS

| | | | | |
|---|---|---|---|---|
| 2,915,195 | A | 12/1959 | Crosby | |
| 3,567,299 | A | 3/1971 | Lundqvist | |
| 3,875,712 | A * | 4/1975 | Thompson | 52/263 |
| 3,900,907 | A * | 8/1975 | Mulder | 5/100 |
| 3,944,309 | A * | 3/1976 | Taniwaki | 104/287 |
| 4,421,365 | A * | 12/1983 | Taniwaki | 312/198 |
| 4,650,085 | A * | 3/1987 | Davies et al. | 220/4.02 |
| 4,771,901 | A * | 9/1988 | Griswold et al. | 211/151 |
| 5,082,178 | A * | 1/1992 | Muth et al. | 238/281 |
| 5,542,549 | A * | 8/1996 | Siemon et al. | 211/26 |
| 6,299,268 | B1 * | 10/2001 | Carle et al. | 312/265.4 |
| 6,315,132 | B1 * | 11/2001 | Hartel et al. | 211/26 |
| 6,474,484 | B1 * | 11/2002 | Miller, Jr. | 211/162 |
| 7,165,497 | B2 | 1/2007 | Gilbert et al. | |
| 7,370,587 | B2 | 5/2008 | Janson et al. | |
| 7,950,331 | B2 * | 5/2011 | Tourdot et al. | 104/108 |
| 2004/0104647 | A1 * | 6/2004 | Nemec et al. | 312/201 |
| 2005/0230337 | A1 * | 10/2005 | Krull | 211/162 |
| 2006/0232174 | A1 * | 10/2006 | Muth et al. | 312/198 |

* cited by examiner

*Primary Examiner* — Darnell Jayne
*Assistant Examiner* — Andres F Gallego
(74) *Attorney, Agent, or Firm* — Andrus, Sceales, Starke & Sawall, LLP

(57) ABSTRACT

A mobile storage unit for a mobile storage system includes a pair of axially extending wheel units, each of which defines spaced apart end areas and includes a wheel arrangement. A storage unit support structure is interconnected with the wheel units, and includes upright support members and shelf support members. A pair of upright support members are engaged with and supported by the end areas of each wheel unit. A lowermost shelf support member is secured to an end area of one of the wheel units. The lowermost shelf support members are secured to the upright support members and to the end areas of the wheel units. Each end area of each wheel unit includes an upwardly facing engagement surface, and the lowermost shelf support member is secured to the upwardly facing engagement surface. The upright support members are also supported by the upwardly facing engagement surface.

17 Claims, 4 Drawing Sheets

CARRIAGELESS MOBILIZED STORAGE UNIT FOR USE IN A MOBILE STORAGE SYSTEM

BACKGROUND AND SUMMARY OF THE INVENTION

The present invention relates generally to mobile storage systems and, more particularly, to a low profile wheel support assembly for use with a mobile storage unit.

Mobile storage systems have long been utilized to store documents, books and other items in a high density manner that also allows for easy access to the items contained on any portion of the mobile storage system. These systems typically include a number of storage units movably mounted on rails that are secured to the floor of a room or other enclosure. By operation of a motive system associated with each of the storage units, individual units may be moved along the rails to expose a desired unit in order to retrieve the items contained therein.

Typically, the mobile storage system consists of a number of carriages that are movable on the rails, in combination with storage units that are mounted to the carriages. The carriages and storage units are separate structures. Each carriage is made up of a structural frame assembly, which includes a series of axial frame members and transverse frame numbers that are secured it together, such as by welding, to form a rigid carriage frame structure. Typically, a set of wheels is mounted to each of the axial frame members. The motive system typically includes a drive shaft that extends between the axial frame members, to impart rotation to the wheels in response to an input force. The input force may be manually applied by a user, or may be a rotational force applied by a motor. While this construction of a mobile storage system is reliable and proven, there are certain disadvantages in that the separate construction of the carriage and the storage units involves a significant number of parts as well as time and cost in assembly of the separate parts. In addition, the carriages, which can be quite large structures, are typically fabricated at a manufacturing facility and then shipped to the installation site. This can result in significant shipping costs.

It is an object of the present invention to provide a mobile storage system which eliminates some of the disadvantages associated with a carriage-type system, such as the separate carriage assembly and the associated time and expense involved in fabrication and the shipment. It is a further object of the present invention to provide a mobile storage system that is relatively simple in its components, and in which the components can be manufactured and shipped to an installation site in a knock-down manner. Yet another object of the present invention is to provide a mobile storage system that is adapted to be constructed on-site relatively quickly using a minimal number of tools, yet which provides adequate strength and rigidity for use in a normal mobile storage application.

In accordance with one aspect, the present invention contemplates a mobile storage unit that includes a pair of axially extending wheel units, each of which defines a pair of spaced apart end areas and includes a wheel arrangement. The mobile storage unit further includes storage unit support structure interconnected with the pair of wheel units. The storage unit support structure is in the form of a series of upright support members and a series of transverse shelf support members that extend between the upright support members. A pair of upright support members are engaged with and supported by the end areas of each wheel unit, and a lowermost one of the shelf support members is secured at each of a pair of opposite ends to an end area of one of the wheel units. The ends of the lowermost shelf support members are preferably secured to a pair of the upright support members and to the end areas of the wheel units. In addition, each end area of each wheel unit includes an upwardly facing engagement surface, and one of the ends of the lowermost shelf support member is secured to the upwardly facing engagement surface. In a preferred embodiment, one of the upright support members engages and is supported by the upwardly facing engagement surface.

The upwardly facing engagement surface is preferably defined by a support member that is secured to the end area of the wheel unit. Each wheel unit includes a structural frame member defining a pair of spaced apart side walls, and the support member is secured to the spaced apart side walls and extends outwardly from the side walls. The structural frame member defines an upper wall that extends between and interconnects the spaced apart side walls, and the upper wall includes a slot at each end area of the wheel unit. Each upright support member includes an axially extending portion that is received within the slot.

The invention also contemplates a method of mobilizing a storage unit that includes a support arrangement including a series of upright support members and a series of transverse shelf support members, substantially in accordance with the foregoing summary. The invention further contemplates a mobile storage unit for use in a mobile storage system, also substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
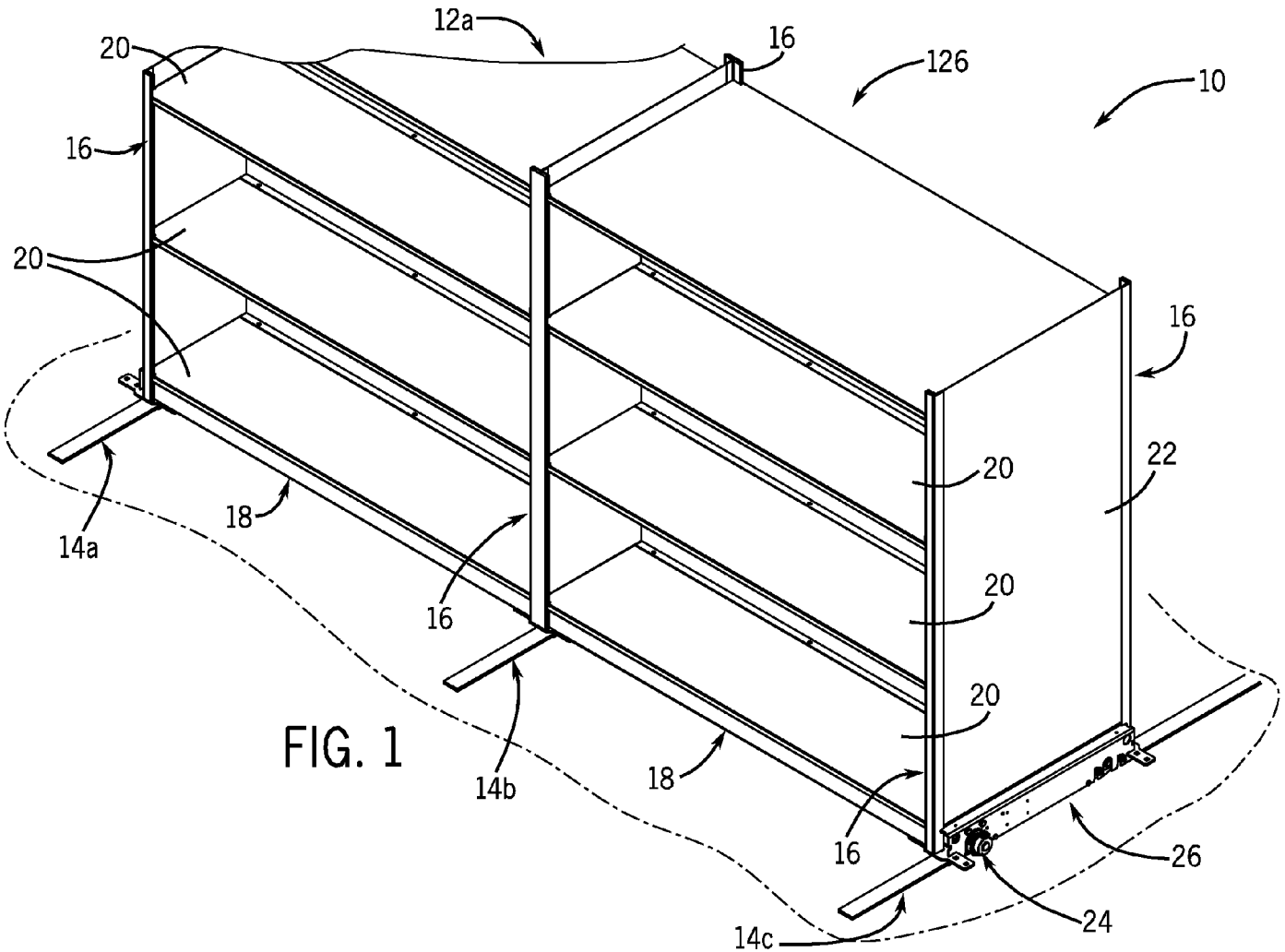
FIG. 1 is a partial isometric view of a mobile storage system, shown as having two mobile storage units, which incorporates storage units constructed in accordance with the present invention.

Referring to FIG. 1, a mobile storage system 10 generally includes a series of storage units, such as shown at 12*a*, 12*b*, which are connected together and are movable on a series of rails, such as shown at 14*a*, 14*b* and 14*c*. Generally, the storage units 12*a* and 12*b* are made up of a series of upright support members 16, the end ones of which are generally L-shaped and the intermediate ones of which are generally T-shaped. A series of shelf support members 18 extend between and interconnect the upright support members 16, and are operable to support a series of shelves 20. It is understood that, while FIG. 1 illustrates two storage units, storage system 10 may be made up of any number of storage units.

Storage units 12*a* and 12*b* are movable on rails 14*a*-14*c* by operation of a drive system that is generally constructed in a manner as known in the art. The drive system includes a manually operated crank that is secured to one of the end panels of the storage system 10, such as shown at 22. The handcrank enables an operator to provide a rotational input force when it is desired to move the storage units 12*a* and 12*b* in one direction or the other. The handcrank functions to drive a chain through a suitable gear drive system, and the chain is trained about an input member, in the form of a sprocket 24. The sprocket 24 provides input power to a drive shaft (not shown in FIG. 1), which is operable to move the storage units 12*a* and 12*b* on the rails 14*a*-14*c*. The drive shaft, in turn, is rotatably secured to, and extends between, a series of wheel units, such as shown at 26. Alternatively, it is understood that instead of a manually operated crank, rotational input power may be provided by an electric motor. In a manner to be explained, the upright support members 16 and the shelf support members 18 are interconnected together along with wheel units 26 to form the storage units 12*a* and 12*b*. This arrangement allows storage system 10 to be constructed in a manner without the use of carriages to which the storage units are mounted, which provides a simplified system that is relatively low in cost and can be shipped to an installation site in a knock-down manner.

FIG. 2-5 illustrate the manner in which the upright support members 16, the shelf support members 18 and the wheel units 26 are connected together to form the storage units. The drawings illustrate connection of the upright support member 16 and shelf support member(s) 18 at one end of a wheel unit 26. It is understood, however, that an upright shelf support member 16 and shelf support member(s) 18 are secured to the opposite end of each wheel unit 26 in the same manner as shown and as will be described.

Figure 2:
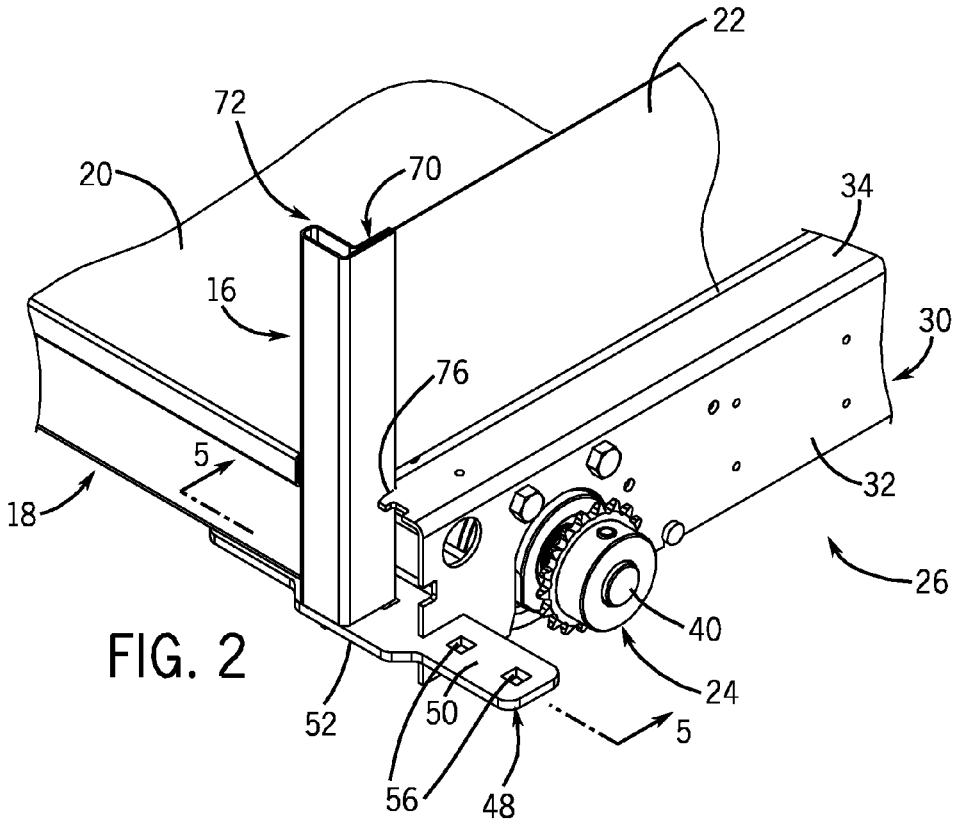
FIG. 2 is a partial enlarged isometric view illustrating a portion of one of the storage units incorporated into the mobile storage system of FIG. 1 and showing construction of the storage units in accordance with the present invention.
Figure 5:
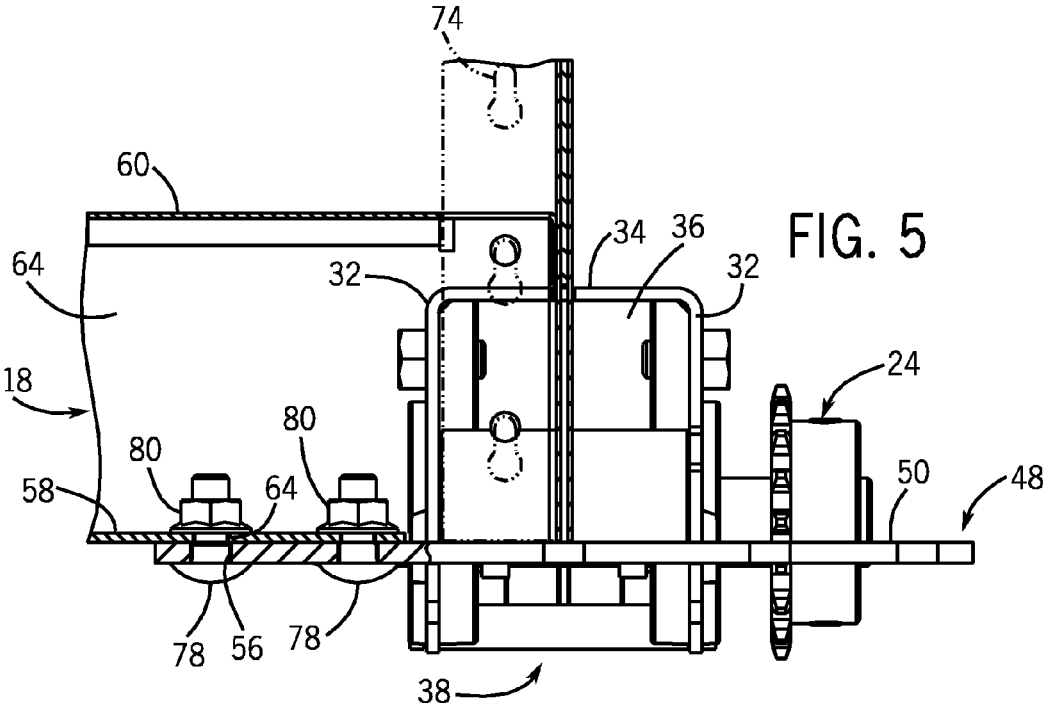
FIG. 5 is a partial section view taken along line 5-5 of FIG. 2.
Figure 3:
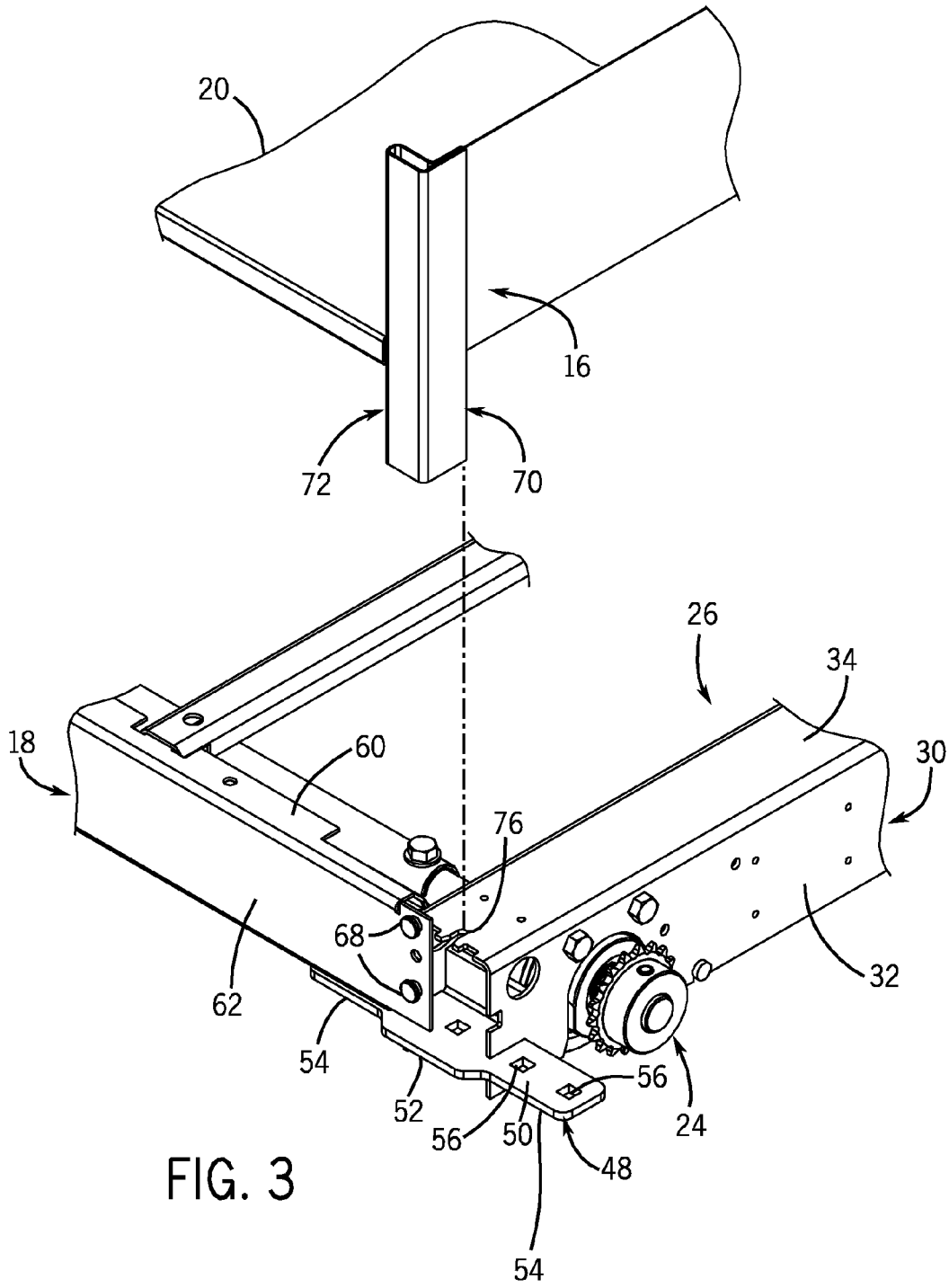
FIG. 3 is a view similar to FIG. 2, showing a portion of the storage unit in exploded fashion.

As shown in FIGS. 2 and 5, each wheel unit 26 includes an axially extending structural support or frame member 30 that performs the dual function of providing the structural foundation of the storage unit as well as providing support for the wheels that impart movability to the storage units. In the illustrated embodiment, the structural frame member 30 is in the form of an inverted U-shaped member having a pair of generally vertical, parallel side walls 32 and a transverse upper wall 34 that extends between and interconnects the side walls 32. It is understood, however, that the structural support or frame member of the storage unit 26 may have any other satisfactory construction as desired. In the illustrated embodiment, the structural frame member 30 defines a downwardly facing interior 36 within which a pair of spaced apart wheel assemblies 38 may be mounted. The wheel assemblies 38 may be in the form of modular wheel assemblies as shown and described in U.S. Pat. No. 7,370,587 issued May 13, 2008, the entire disclosure of which is hereby incorporated by reference. It is understood, however, that the wheel assemblies 38 may have any other satisfactory construction. In a manner as is known, the sprocket 24 is secured to in input stub shaft 40 associated with one of the wheel assemblies 38, so as to provide driving input power to the wheel assembly 38. Also in a manner as is known, the opposite side of the wheel assembly 38 includes a stub shaft 42 (FIG. 4), and a bridging tubular drive shaft section 44 is secured to the stub shaft 42, such as by use of a bolt 46 that extends through aligned openings in shafts 42, 44 and a nut secured to the bolt 46. The bridging tubular drive shaft section 44 spans between the wheel units 26 of storage system 10, to provide rotary power from one wheel unit 26 to the next wheel unit 26 along the entire length of the mobile storage system 10. In this manner, the input power applied to the sprocket 24 by the operation of the handcrank is transferred to the wheel units 26 so as to drive the storage units such as 12*a*, 12*b* along the rails such as 14*a*-14*c*.

At each end, the structural support or frame member 30 is provided with a support member 48 that functions to support the upright support member 16 and the end of shelf support member 18. In the illustrated embodiment, the support member 48 is in the form of a flat planar plate member that defines an upwardly facing engagement surface 50. It is understood, however, that support member 48 may have any other satisfactory configuration. The support member 48 is secured to the end of the support or frame member 30 by means of aligned slots formed in side walls 32 within which the support member 48 is secured. The slots in the side walls 32 function to locate and provide vertical support for the support member 48, and support member 48 may be secured to the side walls 32 in any satisfactory manner, such as by welding. The support member 48 is symmetrical about it centerline, and includes a central portion 52 and a pair of end portions 54. The central portion 52 is aligned with the axial centerline of the structural frame or support member 30, and each end portion 54 extends outwardly from one of side walls 32. The central portion 52 is configured to support the lower end of the upright support member 16, and the end portions 54 are each configured to support the end of one of the shelf supports 18. At the intermediate areas between two adjacent storage units, the end portions 54 of support member 48 each support one of the shelf support members 18. At the end areas of storage system 10, the inner one of the end portions 54 supports a shelf support member 18, and the outer one of the end portions 54 is unused (as shown in FIGS. 2-5) but is concealed by a cover panel that is located outwardly of the end panel 22 end panel that is located outwardly of the end panel. In this manner, a single support member 48 can be used for each of the wheel units 26. It is understood, however, that the support member 48 as shown and described may be used only for the intermediate areas of the storage system 10, and that a support member with a single inner end portion 54 may be used at the end areas of the storage system 10. Each end portion 54 includes one or more openings 56. In the illustrated embodiment, each end portion 54 includes a pair of openings 56, although it is understood the each end portion 54 may have any number of openings 56.

Figure 4:
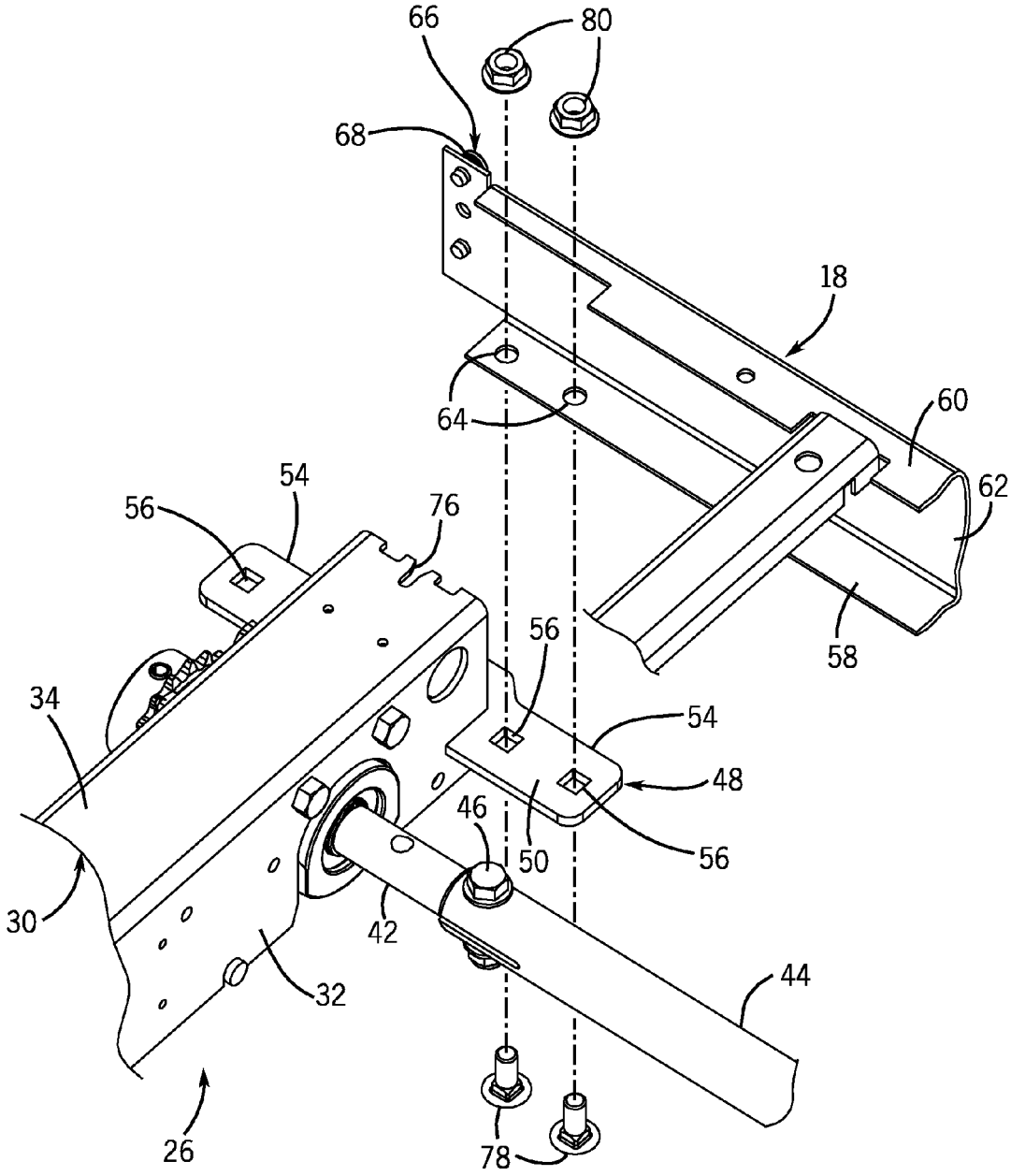
FIG. 4 is an exploded partial isometric view showing the portion of the storage unit shown in FIGS. 2 and 3 from an opposite angle, and showing the storage unit components in exploded fashion.

Referring to FIG. 4, each shelf support member 18may representatively be in the form of a C-shaped member having respective generally horizontal bottom and top flanges 58, 60 and a generally vertical web 62 extending between the flanges 58, 60. The lower flange 58 has a pair of openings 64, which have a spacing that matches that of openings 56 in end portions 54 of support member 48. The vertical web 62 extends beyond bottom flange 58 and top flange 60, and includes a pair of vertically spaced connecting members in the form of connecting rivets 66, each of which includes a shank and an expanded head portion 68, in a manner as is known.

As shown in FIGS. 2-5, the upright support member 16 is in the form of an angle member that includes an axial portion 70 and a transverse portion 72. In a known manner, the axial portion 70 and the transverse portion 72 have a double-walled construction. The walls of axial portion 72 may be secured together, or may have a shelf end wall (either continuous or intermittent) sandwiched therebetween. The walls of transverse portion 72 are preferably spaced apart, and a series of vertically spaced keyhole slots 74 (shown in phantom in FIG. 5) are formed in the inner wall of axial portion 70. Alternatively, it is understood that the axial and transverse portions of upright support member 16 may have a single-wall or any other satisfactory construction. In addition, while the drawings illustrate an L-shaped upright support member 16 for use at the end of a storage unit, it is understood that a T-shaped support member 16 is used at the intermediate areas where adjacent storage units are located, so that a common support member 16 may be used for both of the adjacent storage units.

In assembly, each storage unit, such as 12*a*, 12*b*, are constructed by first securing the shelf support members 18 to the upright support members 16 and then securing the connected shelf support members 18 and upright support members 16 to the support members 48 at the ends of each of a pair of wheel units 30. To accomplish this, the head portions 68 of the connecting rivets at the end of each shelf support member 18 are first secured to the lower end of the upright support member 16 by engaging the head portions 68 of the rivets 66 within keyhole slots 74, in a manner as is known, to form the frame of the storage unit. The connected shelf support members 18 and upright support members 16 are then moved downwardly into engagement with the upwardly facing engagement surface 50 of the support member 48 at each end of the wheel unit 26. The connected shelf support members 18 and upright support members 16 are moved downwardly so that the end of the upright support member 16 is moved into engagement with the upwardly facing surface 50 at central portion 52, and the bottom flange 58 of the shelf support member(s) 18 are moved into engagement with the upwardly facing engagement surface 50 at the end portion 54 so that openings 64 in bottom flange 58 are in alignment with the openings 56 in the end portion(s) 54. As shown in FIG. 4, the upper wall 34 of structural support or frame member 30 includes a central slot 76, which is configured to receive the axial portion 70 of the upright support member 16. The shelf support member(s) 18 are then secured to the support member 48 using bolts 78 that extend through openings 56 and 64, and nuts 80 that are secured to the bolts 78. This construction functions to lock the shelf support member(s) 18 and upright support member 16 together against upwardly facing surface 50 of support member 48.

It can thus be appreciated that the present invention provides a mobile storage system which eliminates the separate carriage assembly as in the prior art, and the associated time and expense involved in fabrication and the shipment of a separate carriage assembly. The present invention also provides a mobile storage system that is relatively simple in its components, and in which the components can be manufactured and shipped to an installation site in a knock-down manner. The mobile storage system may be constructed on-site relatively quickly using a minimal number of tools, and provides adequate strength and rigidity for use in a normal mobile storage application Various alternatives and embodiments are contemplated as being within the scope of the following claims particularly pointing out and distinctly claiming the subject matter regarded as the invention.

I claim:

1. A mobile storage unit, comprising:

a pair of axially extending wheel units, wherein each wheel unit comprises a wheel arrangement and a structural frame member that axially extends along the wheel unit and defines a pair of axially spaced apart end areas having receiving slots;

a pair of support members that are received within the receiving slots and are thereby secured to each of the end areas; and a storage unit support structure interconnected with the pair of wheel units, wherein the storage unit support structure comprises a series of upright support members and a series of transverse shelf support members that extend between the upright support members, wherein a pair of the upright support members are engaged with and supported by the support members at the end areas of each wheel unit, and wherein a lowermost one of the shelf support members is secured at each of a pair of opposite ends to one of the support members at one of the end areas of one of the wheel units.

2. The mobile storage unit of claim 1, wherein the ends of the lowermost shelf support members are secured to the pair of the upright support members and to the support members at the end areas of the wheel units.

3. The mobile storage unit of claim 2, wherein the support member at each end area of each wheel unit includes an upwardly facing engagement surface, wherein one of the ends of the lowermost shelf support member is secured to the upwardly facing engagement surface.

4. The mobile storage unit of claim 3, wherein one of the upright support members engages and is supported by the upwardly facing engagement surface.

5. The mobile storage unit of claim 1, wherein each structural frame member defines a pair of spaced apart side walls, wherein the receiving slots are located in the spaced apart side walls, and wherein the support member extends outwardly from the side walls.

6. The mobile storage unit of claim 5, wherein the structural frame member defines an upper wall that extends between and interconnects the spaced apart side walls, wherein the upper wall includes a slot at each end area of the wheel unit, and wherein each upright support member includes an axially extending portion that is received within the slot.

7. A method of mobilizing a storage unit that includes a support arrangement including a series of upright support members and a series of transverse shelf support members, comprising the steps of:

providing a pair of axially extending wheel units, wherein each wheel unit comprises a wheel arrangement and a structural frame member that axially extends along the wheel unit and defines a pair of axially spaced apart end areas having receiving slots;

providing a pair of support members and securing the pair of support members to each of the end areas by situating the support members within the receiving slots: and securing the upright support members and a lowermost pair of the transverse shelf support members to the support members at the end areas of the wheel units, wherein each transverse shelf support member defines a pair of spaced apart ends, and including the step of securing the ends of the transverse shelf support members to the upright support members and to the support members at the end areas of the wheel units.

8. The method of claim 7, wherein the support member at each end area of each wheel unit includes an upwardly facing engagement surface, wherein the step of securing the ends of the transverse shelf support members to the end areas of the wheel units includes securing the ends of the lowermost shelf support member to the upwardly facing engagement surfaces.

9. The method of claim 8, further comprising the step of supporting the upright support members on the upwardly facing engagement surfaces.

10. The method of claim 9, wherein each structural frame member defines a pair of spaced apart side walls, wherein the receiving slots are located in the side walls, wherein the support member is secured to the spaced apart side walls and extends outwardly from the side walls, and wherein the step of securing the ends of the transverse shelf support members to the support members at the end areas of the wheel units is carried out by securing the ends of the transverse shelf support members to the support member outwardly of the spaced apart side walls.

11. The method of claim 9, including the step of first securing at least one of the lowermost shelf support members to at least one of the upright support members to connect the lowermost shelf support member and the upright support member together, and thereafter securing the connected lowermost shelf support member and upright support member to one of the upwardly facing engagement surfaces.

12. The method of claim 11, wherein the lowermost shelf support member defines a downwardly facing engagement surface that rests on the upwardly facing engagement surface, and wherein the step of securing the connected lowermost shelf support member and upright support member to the upwardly facing engagement surface is carried out by one or more fasteners that extend between and interconnect the upwardly facing engagement surface and the downward facing engagement surface.

13. A mobile storage unit, comprising:

a plurality of wheel units, each of which defines a pair of spaced apart end areas having receiving slots, wherein a support member received within the receiving slots at each end area defines an upwardly facing engagement surface, wherein each wheel unit comprises an axial frame member that extends along the wheel unit and a wheel arrangement interconnected with the axial frame member;

a plurality of upright structural support members; and a plurality of transverse shelf support members;

wherein the upright structural support members and transverse shelf support members are adapted to be secured together and secured to the upwardly facing engagement surfaces defined by the support members at the end areas of the wheel units so as to assemble the wheel units, upright structural support members and transverse shelf support members into the mobile storage unit.

14. The mobile storage unit of claim 13, wherein the axial frame member of each wheel unit defines a pair of spaced apart side areas, wherein the receiving slots are located in the side areas, wherein the support member extends outwardly from the side areas of the axial frame member, and wherein the transverse shelf support members are secured to the support member outwardly of the spaced apart side areas.

15. The mobile storage unit of claim 14, further comprising fasteners that extend between and interconnect the transverse shelf support members to the support member.

16. The mobile storage unit of claim 15, wherein the support member is configured to engage and support one of the upright structural support members and one or more of the plurality of transverse shelf support members that are secured to the upright structural support member.

17. The mobile storage unit of claim 14, wherein the axial frame member defines a transverse wall that is located between the pair of spaced apart side areas, wherein the transverse wall includes a slot at the end area of the wheel unit, wherein the slot is configured to receive a portion of the upright structural support member.

* * * * *